United States Patent [19]

Shirata et al.

[11] Patent Number: 4,543,567

[45] Date of Patent: Sep. 24, 1985

[54] METHOD FOR CONTROLLING OUTPUT OF ALARM INFORMATION

[75] Inventors: Shigenobu Shirata, Fuchu; Kiyoshi Kurihara, Tokyo, both of Japan

[73] Assignee: Tokyo Shibaura Denki Kabushiki Kaisha, Kawasaki, Japan

[21] Appl. No.: 485,108

[22] Filed: Apr. 14, 1983

[51] Int. Cl.[4] ..... G08B 23/00

[52] U.S. Cl. ..... 340/519; 340/506; 340/511; 340/518; 340/657; 340/661

[58] Field of Search ..... 340/519, 518, 511, 506, 340/524, 525, 52 F, 661, 870.21, 657; 364/550

[56] References Cited

U.S. PATENT DOCUMENTS

| | | | |
|---|---|---|---|
| 3,665,399 | 5/1972 | Zehr et al. | 340/525 |
| 3,964,018 | 6/1976 | Strait et al. | 340/52 F |
| 3,964,302 | 6/1976 | Gordon et al. | 340/518 |
| 3,988,730 | 10/1976 | Valker | 340/518 |
| 4,001,785 | 1/1977 | Miyazaki et al. | 340/518 |
| 4,222,041 | 9/1980 | Von Tomkewitsch et al. | 340/505 |
| 4,251,769 | 2/1981 | Ewert et al. | 340/511 |
| 4,459,583 | 7/1984 | van der Walt et al. | 340/511 |

*Primary Examiner*—Donnie L. Crosland

*Attorney, Agent, or Firm*—Schwartz, Jeffery, Schwaab, Mack, Blumenthal & Evans

[57] ABSTRACT

In a method for controlling output of alarm information in a system for monitoring a plant wherein process variables including analog type process variables at respective sensing points in the plant are sampled and each of the sampled analog type process variables is compared with a normal range limit value for determination as to whether it is within a normal range or within an abnormal range, an alarm limit level is determined in accordance with changes that have occurred in the process variable during the latest sampling interval. Output of alarm information is permitted in connection with the process variables that have a priority level whose value is higher than the value of the alarm limit level.

8 Claims, 7 Drawing Figures

METHOD FOR CONTROLLING OUTPUT OF ALARM INFORMATION

BACKGROUND OF THE INVENTION

The present invention relates to a method for controlling output of alarm information in a system for monitoring a plant, such as a thermo-electric power generating plant.

A conventional monitoring system includes an input device, a computer, and a display device, and process variables at various locations or sensing points in the plant are scanned or sampled by means of the input device and read or stored in the computer. Each of the sampled analog type process variables is compared with a limit value dividing the normal and abnormal ranges, and when the process variable is found to be within the abnormal range, alarm information is outputted to attract the attention of a human operator and request him to take some appropriate measure. The alarm information may be in the form of an alarm message displayed on a CRT (cathode ray tube) display device. For instance, alarm messages in connection with 18 (eighteen) process variables can be displayed simultaneously on a single CRT device. When there are more process variables with which an alarm is to be produced, the alarm messages can be displayed on the same CRT in turn, and/or can be displayed on separate CRT's. When the plant is in steady state or the plant is running in a normal, expected manner, the number of alarm messages is limited and the operator can take measures responsive to the alarm messages without considerable delay. However, when unexpected troubles occur there can be so many alarm messages that it is difficult for the operator to cope with the situation. Particularly, it is difficult for him to find out which alarm needs immediate care and which one can wait, and there may occur a considerable delay in taking a necessary measure in response to a "serious" alarm. In addition, there may be considerable delay before some of the alarm messages are actually on the CRT screen, and alarms which require immediate attention may be included in those messages for which display was delayed. This can be another source of delay in responding to the "serious" alarm. Delay in taking a necessary measure can of course lead to a fatal breakdown of the plant.

SUMMARY OF THE INVENTION

An object of the invention is to provide a method for controlling output of alarm information in which important alarms, i.e., alarms which require immediate attention are promptly outputted.

According to the invention, there is provided a method for controlling output of alarm information in a system for monitoring a plant wherein process variables including analog type process variables at respective sensing points in the plant are sampled and each of the sampled analog type process variables is compared with a normal range limit value for determination as to whether it is within a normal range or within an abnormal range, said method comprising the steps of: (A) determining, in accordance with changes that have occurred in the process variable during the latest sampling interval, an alarm limit level; and (B) permitting output of alarm information in connection with the process variables that have a priority level whose value is higher than the value of the alarm limit level.

DESCRIPTION OF PREFERRED EMBODIMENT

Figure 1:
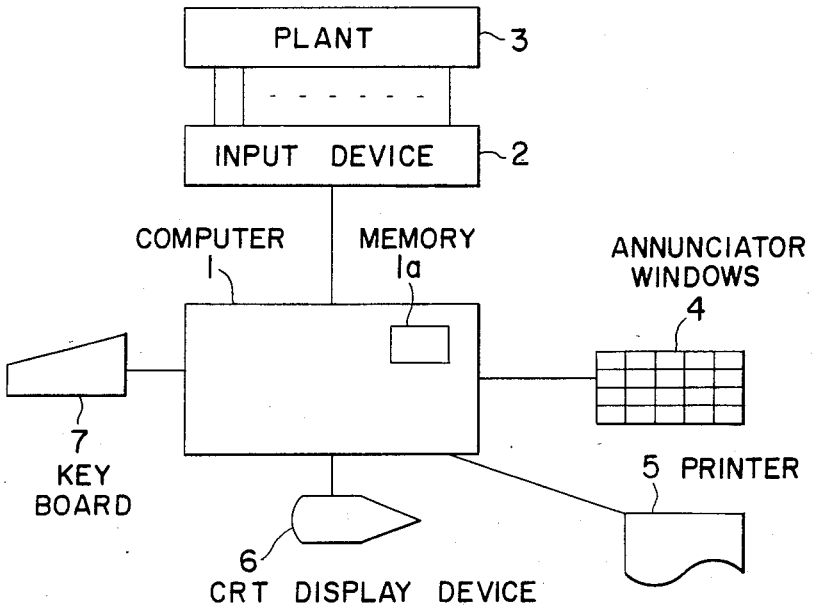
FIG. 1 is a block diagram showing a monitoring system which can be used to implement the method according to the invention.
Figure 2:
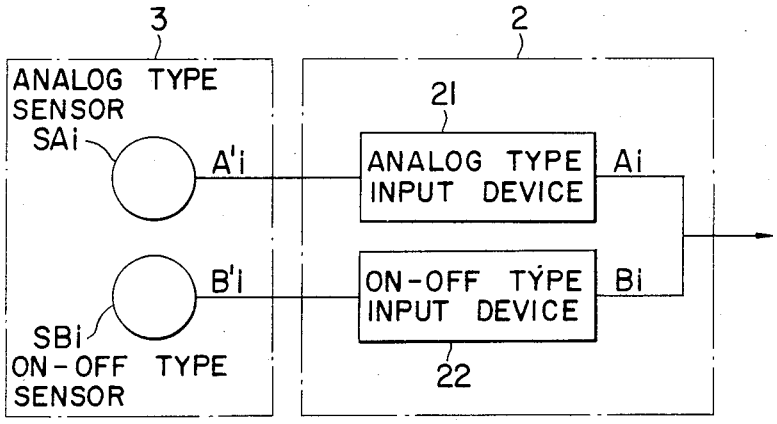
FIG. 2 is a block diagram showing details of the input device 2 shown in FIG. 1.

FIG. 1 shows a monitoring system used for implementing a method according to the invention. The system comprises a computer 1 and an input device 2 connected to receive signals representing process variables at various sensing points or locations in a plant 3. The process variables include analog type process variables Ai' obtained by analog type sensors SAi (i=1, 2, . . .), shown in FIG. 2, provided in the plant 3. They also include ON-OFF type process variables Bi' obtained by ON-OFF type sensors SOi (i=1, 2, . . . ), shown in FIG. 2, each of which assumes either of two alternative values or states at any particular instant. The input device 2 accordingly includes an analog type input device 21 for receiving analog type process variables and converting them into digital values Ai, and an ON-OFF type input device 22 for receiving ON-OFF type process variables and converting them into binary ("1" or "0") signals Bi. The process variables are scanned or sampled at a substantially but not exactly constant interval, and read or stored in a memory 1*a* of the computer 1.

In a manner which will be described in detail, the computer 1 compares each of the sampled analog type process variables with a normal range limit value, predetermined and stored, for determination as to whether the process variable is within a normal range or within an abnormal range. One of the values or states of some of the ON-OFF type process variables may be defined as abnormal, and the other normal. With the remaining ON-OFF type process variables, both values or states are defined as normal. The information on these definitions is stored in the memory 1*a* and the computer 1 determines whether each ON-OFF type process variable is normal or abnormal. In addition, the computer determines, in accordance with changes that have occurred in the process variable during the latest sampling interval, an alarm limit level, and permits output of alarm information in connection with those process variables which have a priority level, whose value is higher than the value of the alarm limit level.

In the preferred embodiment, the alarm limit level is determined in accordance with a change index which represents the amount of significant changes of the process variable per unit time, and also in accordance with significant changes in pre-designated process variables. The pre-designation is made to those process variables which are mostly ON-OFF type process variables, and have a great effect on the plant and whose significant change will lead to significant changes of a number of other process variables. And the arrangement is such that if a significant change occurs in any of the pre-designated process variables the alarm limit level is promptly raised to a predetermined value (except where the alarm limit level is already at or higher than such level, in which case the current alarm limit level is maintained), and maintained at such level for a predetermined duration. For this purpose, a value constituting an alarm limit level and a time length of the duration are predetermined for each of the predesignated process variables.

The priority level of each analog type process variable may be determined in accordance with an escape degree representing the degree of escape of the sampled value of the process variable from the normal range, i.e., the degree of penetration into the abnormal range. The priority level for each of those ON-OFF type process variables on which one of the states is defined as abnormal may be determined in advance depending on the importance of the process variable.

Annunciator windows 4 are respectively provided in association with the process variables and each annunciator window begins blinking when output of alarm information is permitted in connection with the associated process variable.

A printer 5 is used to make an historical log or a record of the data including the data concerning the process variables which have been in the abnormal range.

A CRT (cathode ray tube) display device 5 is used to display alarm messages in connection with those process variables on which the computer 1 has permitted output of alarm information.

A keyboard 7 is used for input of commands by the operator.

Figure 3:
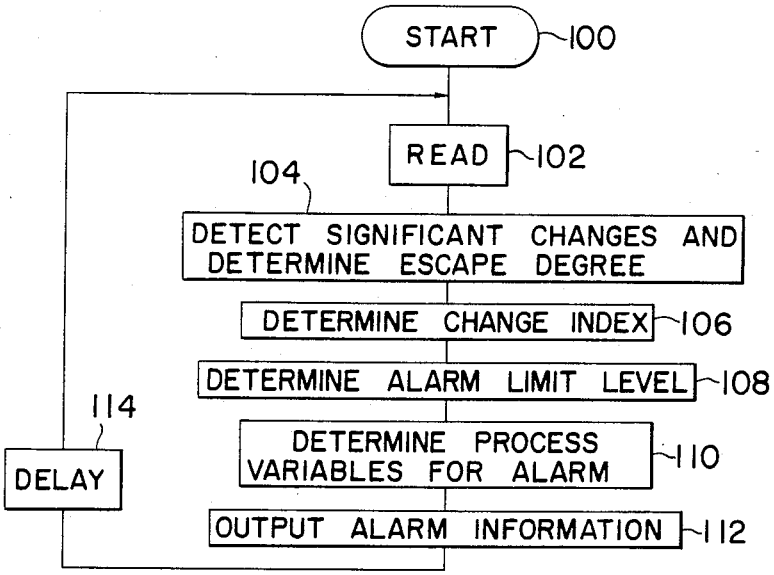
FIG. 3 is a flowchart showing the operation of the monitoring system for control of output of alarm information.

Operation for control of output alarm information will now be described in detail with reference to FIG. 3. After the system is started (100), the process variables are scanned and sampled (102). It is desirable that the interval between successive sampling instants be constant. Such interval can be kept constant if the scan is made by a hardware. But, where a software is used for the scan, the interval cannot be kept exactly constant due to interrupts by other programs.

Then, judgement is made on each of the sampled process variables as to whether it is normal (in normal range) or abnormal (in abnormal range) and whether a significant change has occurred during the latest sampling interval.

The judgement on each analog type process variable is made in the following manner. First, the sampled value Ai of the process variable is compared with a predetermined normal range limit value Ci. If $$Ai > Ci \quad (1)$$

the process variable is found to be in the abnormal range. The information on this finding is stored and used to form part of the record made by the printer 5. The information that the process variable was in the abnormal range at the latest sampling and it was in the normal range in the preceding sampling also constitutes a recognition that a significant change occurred in that process variable during the latest sampling interval.

Where the condition (1) is not satisfied, (i.e., the process variable was in the normal range at the latest sampling), then the memory 1*a* is referred to for detection whether or not the process variable Ai was in the abnormal range. If Ai was in the abnormal range at the preceding sampling, then a finding that a significant change occurred during the latest sampling interval is made.

For each of those process variables Ai which have been found to be in the abnormal range, further analysis is made to determine the escape degree, depending on which one of zones the sampled value of the process variable is in. The zones are formed in the abnormal range, adjacent to each other and have equal width, and numbered sequentially in the order of closeness to the normal range and the process variable in a zone is said to be the escape degree of a value equal to the zone number of the zone in which it is in. The width of the zones of the process variables may be determined such that the ratio of the width Wi of the zone to the span between the normal range limit and a critical point at which immediate breakdown is expected is smaller for more important process variables. This will make it possible for the more important process variables to have greater and quicker chance of being indicated when less important process variables are also in the abnormal range. However, in an alternative arrangement, the above-mentioned span is divided into the equal number (e.g., 15) of zones.

The determination of the escape degree, i.e., the zone in which the process variable is in, can be made by determining a value m which satisfies the following relationship.

$$Ci + mWi \geqq Ai > Ci + (m-1)Wi \quad (2)$$

The resultant value is the escape degree of the process variable.

If the escape degree of a process variable (that has been found to be in the abnormal range both at the latest and the preceding sampling) at the latest sampling differs from the escape degree at the preceding sampling, then a finding that a significant change occurred during the latest sampling interval.

In summary, a significant change is found to have occurred in an analog type process variable, if the value of the process variable at the latest sampling was in the abnormal range while it was in the normal range at the preceding sampling, or if the value of the process variable at the latest sampling was in the normal range while it was in the abnormal range at the preceding sampling, or if the escape degree of the process variable at the latest sampling differs from the escape degree at the preceding sampling.

The information concerning the detected significant changes and the detected escape degrees is stored in the memory 1*a* for further processing and future use. The "further processing" includes comparison of the escape degree with an alarm limit level later determined. The "future use" includes use for comparison with the escape degree or the range (normal or abnormal) at the next sampling.

Figure 4:
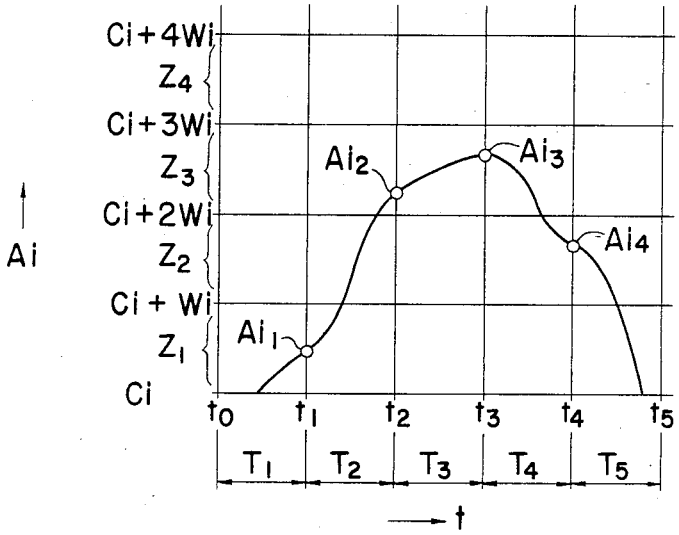
FIG. 4 is a time chart showing variation in an analog type process variable in the abnormal range.

FIG. 4 shows an example of variation of an analog type process variable Ai. Denoted by $t_0, t_1, t_2, \ldots t_6$ are time instants at which the process variable Ai is sampled, while $T_1, T_2, \ldots T_6$ denote intervals between successive time instants of sampling. $Z_1, Z_2, Z_3, Z_4$ denote the zone numbers divided by threshold values Ci+Wi, Ci+2Wi, Ci+3Wi, Ci+4Wi and the suffixes of the zone numbers are identical to the escape degree. At $t_0$, Ai is in the normal range (below Ci). At $t_1$, Ai is in the zone $Z_1$ and the escape degree is 1. Similarly, at $t_2$, $t_3$, $t_4$, respectively the escape degree is 3, 3, 2. At $t_5$, Ai is again in the normal range. A significant change is found to have occurred during the intervals $T_1$, $T_2$, $T_4$, $T_5$ (not $T_3$).

Detection of a significant change is an ON-OFF type process variables is much simpler. If the value or the state of an ON-OFF type process variable at the latest sampling differs from that at the preceding sampling, it is found that a significant change occurred during the latest sampling interval. Information on the finding is stored in the memory 1*a*. The values of all the ON-OFF type process variables may be used to form part of the record made by the printer 5.

The significant changes thus detected are used to determine a change index CI (106). For instance the change index is determined by adding respective weighting factors of the stored significant changes which have occurred during the latest sampling interval and dividing the sum by the time length of the latest sampling interval. In addition, a filtering or smoothing (an example will be described later) can be made. The weighting factor is determined in advance and stored. Each significant change is assigned a weighting factor which may be dependent on (1) which process variable the significant change is related to; (2) whether the change is (a) a change from the normal to abnormal region, e.g., the change that occurred during $t_0-t_1$ in FIG. 4 (DEPARTURE), (b) a change from the abnormal to normal region, e.g., $t_4-t_5$ (RETURN), (c) a change, within the abnormal range, farther from the normal range, e.g., $t_1-t_2$ (WORSE), or (d) a change, within the abnormal range, toward the normal range, e.g., $t_3-t_4$ (BETTER). In a simplified form, the weighting factor is dependent on (1) whether the significant change occurred on the analog type process variable or on the ON-OFF type process variable and, if on the analog type process variable, on (2) the mode of change, i.e., whether it is DEPARTURE, RETURN, WORSE or BETTER. Moreover, the division by the time length of the sampling interval can be omitted (or replaced by division by a predetermined constant representing the time length of the sampling interval where the sampling interval) is constant. With the weighting factors dependent solely on (2) the mode of change and the division by the sampling interval omitted, and with a filtering determination of the change index $CI_n$ at each sampling can be made according to the following equations (C1–C7).

$$CI_n = a_C \cdot CI_n' + (1-a_C) \cdot CI_{n-1} \quad \text{(C1)}$$

where $a_C$ is a filtering constant satisfying $0<a_C<1$, $CI_{n-1}$ is the change index determined at the preceding sampling, and $CI_n'$ is given by the following equation (C2)

$$CI_n' = K_D \cdot D_n + K_W \cdot W_n + K_B \cdot B_n + K_R \cdot R_n + K_O O_n \quad \text{(C2)}$$

where $K_D$, $K_W$, $K_B$, $K_R$ are weighting factors for significant changes of DEPARTURE, WORSE, BETTER and RETURN on an analog type process variable and $K_O$ is a weighting factor for a significant change on an ON-OFF type process variable, and $D_n$, $W_n$, $B_n$, $R_n$, $O_n$ are values given respectively by the following equations (C3)–(C7).

$$D_n = a_D \cdot ND_n + (1-a_D) \cdot D_{n-1} \quad \text{(C3)}$$

$$W_n = a_W \cdot NW_n + (1-a_W) \cdot W_{n-1} \quad \text{(C4)}$$

$$B_n = a_B \cdot NB_n + (1-a_B) \cdot B_{n-1} \quad \text{(C5)}$$

$$R_n = a_R \cdot NR_n + (1-a_R) \cdot R_{n-1} \quad \text{(C6)}$$

$$O_n = a_O \cdot NO_n + (1-a_O) \cdot O_{n-1} \quad \text{(C7)}$$

where $a_D$, $a_W$, $a_B$, $a_R$, $a_O$ are filtering constants which are larger than zero and smaller than 1, $ND_n$, $NW_n$, $NB_n$, $NR_n$ are respectively numbers of significant changes of the respective modes, i.e., DEPARTURE, WORSE, BETTER, RETURN which occurred during the latest sampling interval on the analog type process variables and $NO_n$ is the number of significant changes which occurred during the latest sampling interval on the ON-OFF type process variables, $D_{n-1}$, $W_{n-1}$, $B_{n-1}$, $R_{n-1}$, $O_{n-1}$ are values similar to $D_n$, $W_n$, $B_n$, $R_n$, $O_n$ determined at the preceding sampling. For further simplification, however, all the weighting factors may have the identical value of, e.g., 1 (unity). In this case, determination of the change index can be achieved by simply counting the number of the significant changes.

Figure 5:
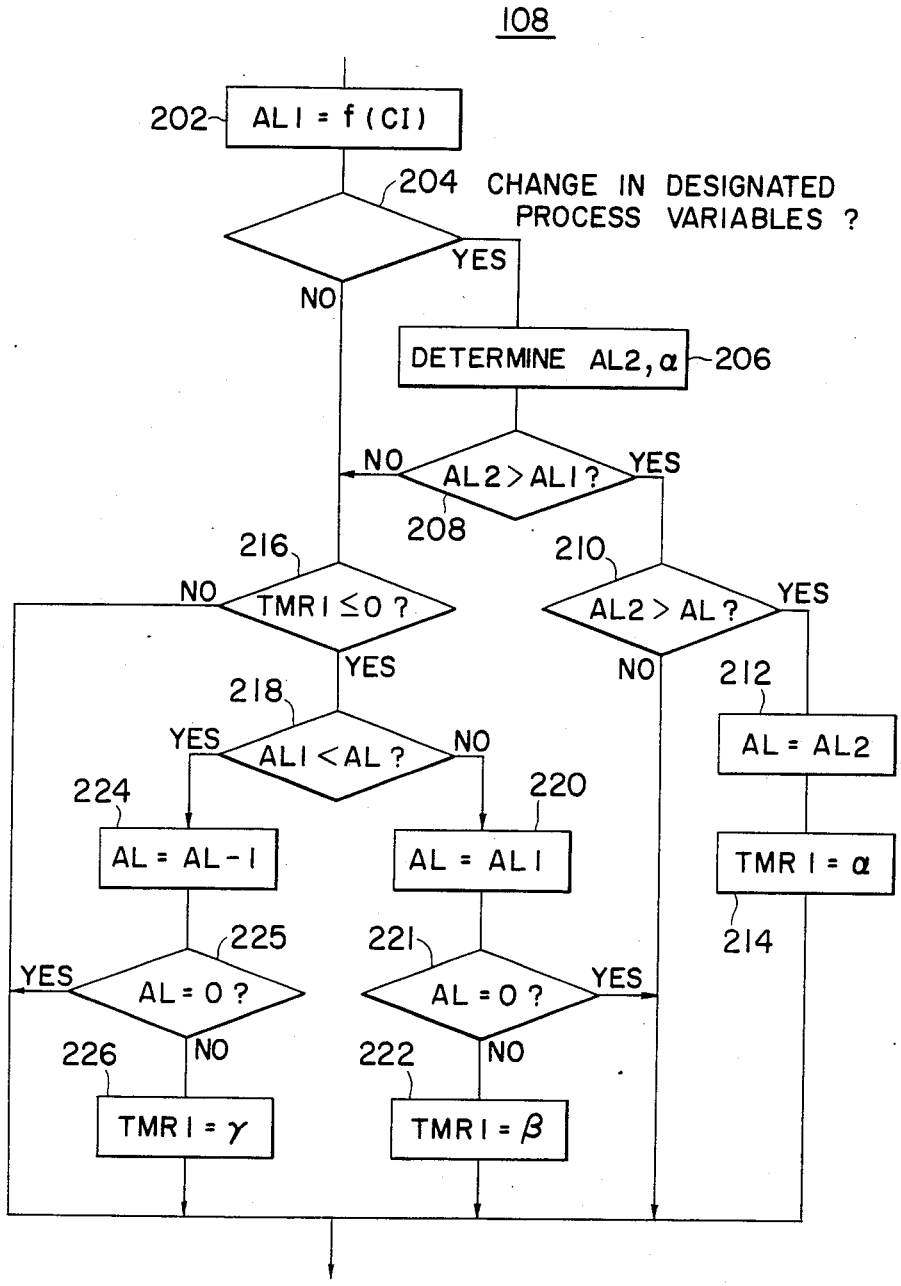
FIG. 5 is a flowchart showing the details of the step 108 shown in FIG. 4.

An alarm limit level is determined (108) in accordance with the change index CI determined at a step (106) and also in accordance with the information (obtained at a step 104) on the significant changes in the pre-designated process variables. The manner of determining the alarm limit level is shown in detail in FIG. 5.

First, a first alarm limit level AL1 is determined (202) in accordance with the change index CI. The relationship between any given change index CI and the first alarm limit level AL1 is determined in advance and stored in the memory 1*a*, and the determination of the first alarm limit level is made by referring to such stored information.

The relationship between the change index CI and the first alarm limit level AL1 is so determined as to optimize or control the amount of alarm information (outputted per unit time) and the tendency in the variation of the amount of alarm information (as a function of the change index). The amount of alarm information at any particular situation can be increased if the operator has a greater capability of taking necessary actions or measures responsive to the alarms. The tendency in the variation of the amount of alarm information may be sought to be such that it is substantially constant regardless of the change index, or it decreases when the change index increases. With the latter tendency, it is easier for the operator to concentrate on the process variables that require the most prompt attention.

Figure 6:
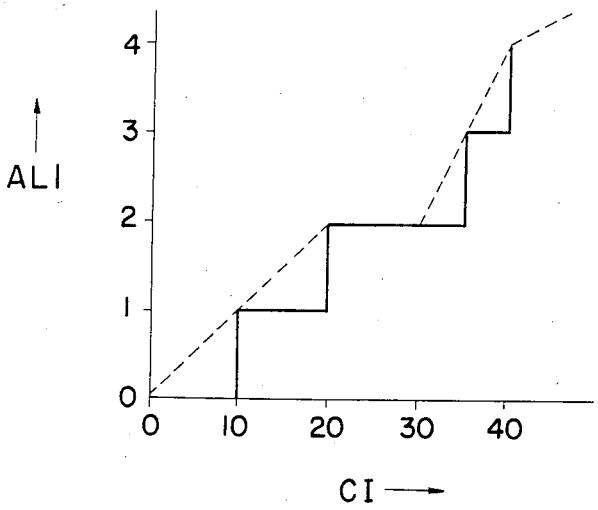
FIG. 6 is a diagram showing a relationship between a first alarm limit level and a change index.

An example of the relationship between the change index and the first alarm limit level AL1 is shown in FIG. 6, according to which the relationship is of a steppingly changing function, and the first alarm limit level assumes discrete values of natural numbers (0, 1, 2, 3, 4, . . .). It will be appreciated that if the gradient is generally lenient, the amount of alarm information tends to be greater so that the operator must have a greater capability of taking measures.

At a step 204, it is judged whether or not a significant change occurred in any of the pre-designated process variables. If the answer is affirmative, then at a step 206, a second alarm limit level AL2 is determined in accordance with the values predetermined for the respective one of the pre-designated process variables. If a significant change occurred in just one of the pre-designated process variables, the second alarm limit level AL2 is set at the value predetermined for that process variable in which the significant change occurred. When a significant change occurred in two or more process variables, the maximum value among those predetermined for those process variables in which the significant change occurred is selected as the second alarm limit level AL2.

Next, the first alarm limit level AL1 and the second alarm limit level AL2 are compared with each other (208). If the latter is found to be greater, then it is compared with the present alarm limit level AL (210). And if AL2>AL, then the value of AL2 is used as the new alarm limit level AL (212), and a timer TMR1 is set at the duration $\alpha$ (214) predetermined in connection with the second alarm limit level AL2 which has been adopted for the new alarm limit level.

If, at the step 208, it is found that AL2 is not greater than AL1, then it is judged whether the timer TMR1 is up, i.e., whether the delay time previously set in the timer TMR1 has elapsed (216). If the timer is up, it is judged whether AL1<AL (218). If the answer is negative, the value of the first alarm limit level AL1 is set as the new alarm limit value AL (220), and judgement is made as to whether AL=0 (221). Provided that AL≠0, a predetermined time $\beta$ is set in the timer TMR1 (222). The timer TMR1 is used to avoid too frequent a change of the alarm limit level. The timer TMR1 used is shown to be of a type whose value is initially set to a value indicative of the desired delay time and is decreased by 1 each time a predetermined unit time (e.g., one second) elapses.

If, at the step 218, it is found that AL1<AL, then the present alarm limit level AL minus 1 (unity) is set as the new alarm limit level (224). The value AL−1 is used rather than AL1 (<AL) for the new alarm limit level to avoid a sudden drop of the alarm limit which may cause a sudden increase in the number of alarm messages. After that, judgement is made as to whether AL=0 (225). Provided that AL≠0, a predetermined time $\gamma$ is set in the timer TMR1 (226). The value of $\gamma$ is usually smaller than the value of $\beta$.

When the alarm limit level AL is thus determined, then, at step 110 (FIG. 3), discrimination as to on which process variables output of alarm information should be permitted is made. The discrimination on the analog type process variables is made according to the following criterion. If the value of the escape degree (as determined at the step 104) for a particular process variable in question is greater than the value of the alarm limit level AL determined at the step 108 output of alarm information is permitted in connection with such process variable. This means that, as exemplified in FIG. 7, output of alarm information is permitted in connection with those process variables in a zone, when shown in normalized form, above the alarm limit level AL indicated by broken lines and display of alarm information of the process variables below the alarm limit level (although in the abnormal range) is suppressed.

The discrimination on the ON-OFF type process variables is made in the following manner. Each of those ON-OFF type process variables on which one of the states is defined as abnormal is assigned a rank RA whose value is one of natural numbers (1, 2, 3,.... ). The rank for each of the ON-OFF type process variables is determined in accordance with the general importance of the process variable. In other words, a rank of a greater value is assigned to a process variable which is generally important. The information on the rank of the ON-OFF type process variables is stored in the memory 1*a*. The stored rank RA is compared with the alarm limit level AL determined at the step 108 and output of alarm information is permitted in connection with those process variables whose rank RA is higher than the alarm limit level, and which is in the "abnormal" state.

The information on the result of the discrimination is stored in the memory 1*a*.

When the process variables on which an alarm should be produced are determined, then the alarms are produced for the respective process variables. More particularly, alarm messages for the respective process variables, each including the name of the sensing point, the current value of the process variable, the normal range limit value, and the escape degree, are formed, and stored to be displayed on the CRT. If there are more alarm messages than can be displayed simultaneously on the screen of the CRT, they are displayed in turn and/or on two or more CRT's. With such an arrangement, display on the CRT of too many alarm messages is avoided and only those messages which require more prompt attention are displayed.

The annunciator windows 4 start blinking when the judgement that an alarm should be produced is made in connection with the associated process variables. The blinking is terminated when the operator acknowledges the alarm by the use of the keyboard 7.

The data on variations of the process variables including data on excursions in the abnormal range are also recorded and outputted by the printer 5.

After the output of the alarm messages, a time delay is made before the next scan or sampling (102) is initiated. This is to provide a certain sampling interval. The length of the time delay is so determined that the actual sampling interval is a desired value. But because of interrupts by other programs, the actual sampling interval may not be constant, and this is the reason why, under certain circumstances, the actual sampling interval is taken account of in determining the change index CI at 106.

Figure 7:
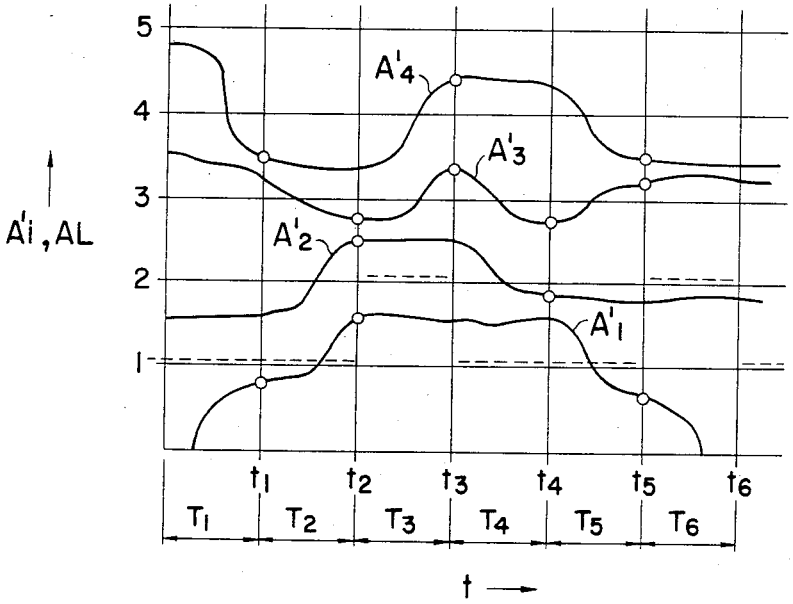
FIG. 7 is a time chart showing variation in analog type process variables.

Assume for example that there are four analog type process variables in the abnormal range as shown in FIG. 7. At the respective sampling instants $t_1-t_5$, those process variables with mark "0" are found to have experienced a significant change and the information on such findings is stored. Assume that no significant changes have occurred in the ON-OFF type process variables during the period under consideration. Assume also that the time instants at which the alarm limit level is renewed happen to coincide with the sampling instants. The alarm limit determined in accordance with the significant changes may for example be as shown by the broken lines. It will be seen that reflecting the greater number (three) of significant changes found at $t_2$ and $t_5$ the alarm limit level during the subsequent sampling intervals $T_3$ and $T_6$ is at 3, while it is at 2 for the remaining sampling intervals which follow the instants $t_1$, $t_3$, $t_4$, at which the smaller number (two) of significant changes was found.

As a result, during the interval $T_2$, alarms are produced in connection with the process variables $A_2$, $A_3$, $A_4$, but not the process variable $A_1$ which is below the alarm limit at $t_1$. Similarly, during $T_3$, alarms are produced on $A_2$, $A_3$, $A_4$, but not $A_1$ which is again below the new alarm limit (level 2). During $T_4$ and $T_5$, alarms are produced on all of $A_1$–$A_4$ since they are all above the alarm limit (level 1). During $T_6$, alarms are produced on $A_3$, $A_4$, but not $A_1$, $A_2$ which are below the alarm limit (level 2).

It will be seen that the number of the alarm messages whose output is permitted tends to be smaller when the number of significant changes increases. Thus, when the plant is unstable and many process variables is or near the abnormal range fluctuate, the amount of alarm information outputted is restricted, that is the alarm information is outputted only in connection with those process variables having higher priorities, i.e., requiring most prompt attention.

It should be noted that control of optimizing of the amount of alarm information (per unit time) and the tendency in the variation of the amount of alarm information can be achieved by appropriate selection and adjustment of the conditions for determining the alarm limit level, the escape degree of each of the analog type process variable and the rank of each of the ON-OFF type process variables.

In the description of the step 202, it was assumed that only one function giving the alarm limit level AL1 according to the change index CI is prepared and stored in the memory 1*a*. But the arrangement may alternatively be such that two or more different functions each giving the alarm limit level AL1 according to the change index CI are provided to allow selection by the operator by the use of the key board 7.

There may be provided an additional capacity with which the alarm limit level AL automatically calculated can be manually modified by the use of the keyboard, e.g., increased or decreased by 1.

It should be noted that the normal range limit value described is not necessarily an upper limit value but can also be a lower limit value.

In the above description, it was assumed that all the process variables are sampled through the input device 2 from the plant and all such sampled data are used for determination of the alarm limit level. But, the sampling of the process variables may be carried out at different intervals and stored in the computer memory 1*a* for different purposes. In addition, values of some process variables are determined by calculation based on the values of other process variables, and the result of the calculation is stored (and updated) in the computer memory 1*a*. In these situations, the "sampling" for the purpose of determination of the alarm limit level is not necessarily sampling through the input device (from the sensors) but can also be sampling from the computer memory 1*a*.

In the embodiment described, a rank is assigned to ON-OFF type process variables and is used as the priority level of each of the ON-OFF type process variables, while an escape degree is determined on each analog type process variable and is issued as the priority level of the analog type process variable. But the arrangement may be such that a rank is assigned also to each analog type process variable and the priority level of each analog type process variable is determined in accordance with the rank alone or both of the rank and the escape degree. The latter alternative may be in the form of which the greater one of the rank or the escape degree is used as the priority level.

It should also be appreciated that the above described method for controlling output of alarm information can be implemented by part of a monitoring system which has other functions than outputting alarm information. Accordingly, the same set of data and/or the same hardware can be used both for control of alarm information output and the other functions. For instance, the current state of each of those ON-OFF type process variables on which none of the states is defined as abnormal can be outputted. The determination of the state can be made according to the same sampled data and the output can be effected by the same CRT display device as is used for outputting the alarm messages or by a different CRT display device.

What is claimed is:

1. A method for controlling output of alarm information in a system for monitoring a plant wherein process variables including analog type process variables at respective sensing points in the plant are sampled and each of the sampled analog type process variables is compared with a normal range limit value for determination as to whether it is within a normal range or within an abnormal range, said method comprising steps of:

(A) determining, in accordance with changes that have occurred in the process variable during the latest sampling interval, an alarm limit level; and (B) permitting output of alarm information in connection with the process variables that have a priority level whose value is higher than the value of the alarm limit level.

2. A method as set forth in claim 1, wherein the priority level for each analog type process variable is determined in accordance with an escape degree representing the degree of escape of the sampled value of the process variable from the normal range.

3. A method as set forth in claim 2, wherein the process variables further include ON-OFF type process variables which assume either of two alternative values at any particular instant and the priority level for each of the ON-OFF type process variables for which one of the values is defined as abnormal is determined in advance depending on the importance of the process variable.

4. A method as set forth in claim 2, wherein adjacent zones of an equal width are formed in the abnormal range, and the escape degree is determined according to which zone the sampled value of the process variable occupies.

5. A method as set forth in claim 4, wherein the ratio of the width of the zone to the span between the normal range limit and a critical point at which an immediate breakdown is expected is smaller for more important analog type process variables.

6. A method as set forth in claim 1, wherein the determination of an alarm limit level at said step (A) is made in accordance with the sum of those weighting factors which are assigned to the process variables in which a significant change occurred during the latest sampling interval, a significant change in connection with each analog type process variable being found to have occurred if the value of the process variable was in the abnormal range at the latest sampling while it was in the normal range at the preceding sampling, or if the value of the process variable was in the normal range at the latest sampling while it was in the abnormal range at the preceding sampling, or if the escape degree of the process variable at the latest sampling differs from the escape degree at the preceding sampling.

7. A method as set forth in claim 6, wherein the process variables further include ON-OFF type process variables which assume either of two alternative values at any particular instant and the priority level for each of those ON-OFF process variables on which one of the vallues is defined as abnormal is determined in advance depending on the importance of the process variable, and a significan change in connection with each ON-OFF type process variable is found to have occurred if the value of the ON-OFF type process variable at the latest sampling differs from that at the preceding sampling.

8. A method as set forth in claim 6, wherein when a significant change occurs in one of a pre-designated process variables during the latest sampling interval, a second alarm limit level is set depending on in which pre-designated process variable the significant change occurred, and the greater one of the second alarm limit level and the first mentioned alarm limit level is used as the effective alarm limit level.

* * * * *